US006334270B1

(12) United States Patent
Ko

(10) Patent No.: US 6,334,270 B1
(45) Date of Patent: Jan. 1, 2002

(54) STRUCTURE OF AN ADORNMENT

(76) Inventor: Fu-Chung Ko, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/814,297

(22) Filed: Mar. 20, 2001

(51) Int. Cl.[7] ..... G09F 19/00
(52) U.S. Cl. ..... 40/406; 446/267
(58) Field of Search ..... 40/406, 409, 410, 40/439; 446/267

(56) References Cited

U.S. PATENT DOCUMENTS 5,174,760 A * 12/1992 Gray ..... 40/406
5,706,594 A * 1/1998 Lin ..... 40/406
5,857,277 A * 1/1999 Mayze ..... 40/410
5,946,968 A * 9/1999 Lee ..... 40/406
6,003,392 A * 12/1999 Lee ..... 40/406

* cited by examiner

*Primary Examiner*—Cassandra H. Davis

(57) ABSTRACT

A structure of an adornment includes a base, a disk projected upward from the base, a rotatable transparent circular container positioned in front of the disk and drove by a motor inside the disk, a clock, a microphone and a pair of swivel buttons located in front of the base and connected to a battery chamber via the electrical circuit inside the base. The container contains two kinds of liquids of different specific gravities, and a buoy in the liquids. A painting a concentrical locus and a plurality of small windows in the back of the container, thereby rotation of the container provides great fun on the sense of sight.

9 Claims, 4 Drawing Sheets

STRUCTURE OF AN ADORNMENT

BACKGROUND OF THE INVENTION

The present invention relates to decorative art and more particularly to a structure of an adornment which contains two kinds of liquids of different specific gravities and ornaments. When swings the adornment or puts it upside down, the liquids such as water and oil provide convectional effect to affect the ornaments moving inside the container in order to give great fun on the sense of sight.

Most of the similar adornments are structurally too simple. It could not be always attractive. Although, some of the producers use an electrical bar to stir the liquid in order to create waves. But the result is not so ideal.

SUMMARY OF THE PRESENT INVENTION

The structure of an adornment of the present invention comprises generally a base and a rotatable transparent container containing two kinds of liquids of different specific gravities and the ornaments, a disk projected upward from the base having a motor to drive the container to rotate and at least a small lamp. The container has a circular transparent locus, a plurality of transparent windows and paintings on the back. The base has a clock, a pair swivel buttons and microphone for broadcasting the musics. When the container is rotating, the waves are aroused on the surface of the water and the transparent locus together with the transparent windows provide glinting effect.

Accordingly, the main object of the present invention is to provide a structure of an adornment in which the waves are aroused by rotation of the container and provides glinting effect.

Another object of the present invention is to provide a structure of an adornment which can broadcast the musics and announce the time.

The present invention will become more fully understood by reference to the following detailed description thereof when read in conjunction with the attached drawings.

DETAILED DESCRIPTION OF THE PREFERRED EMBODIMENT

Figure 1:
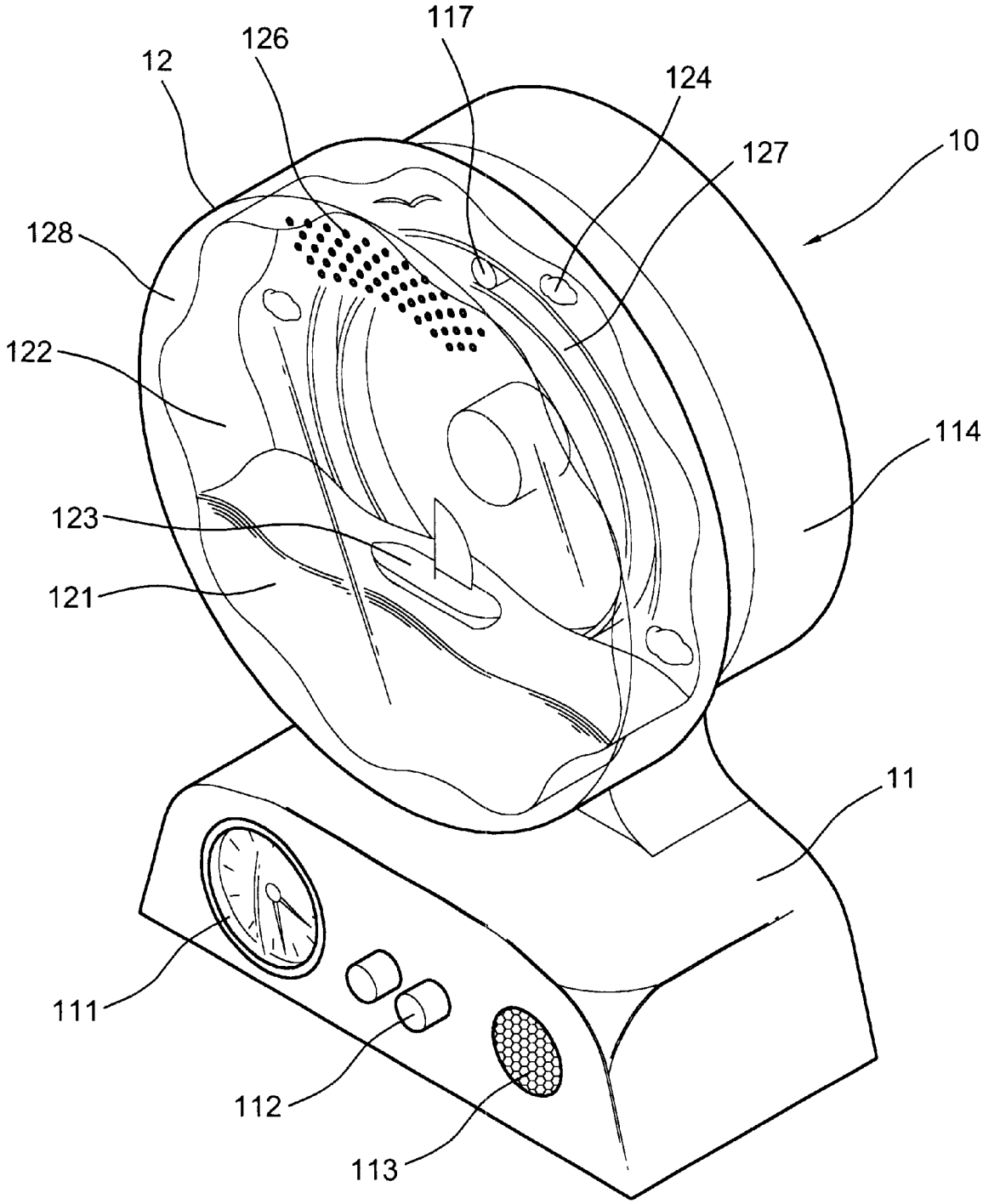
FIG. 1 is a perspective view to show an adornment of the preferred embodiment of the present invention.
Figure 2:
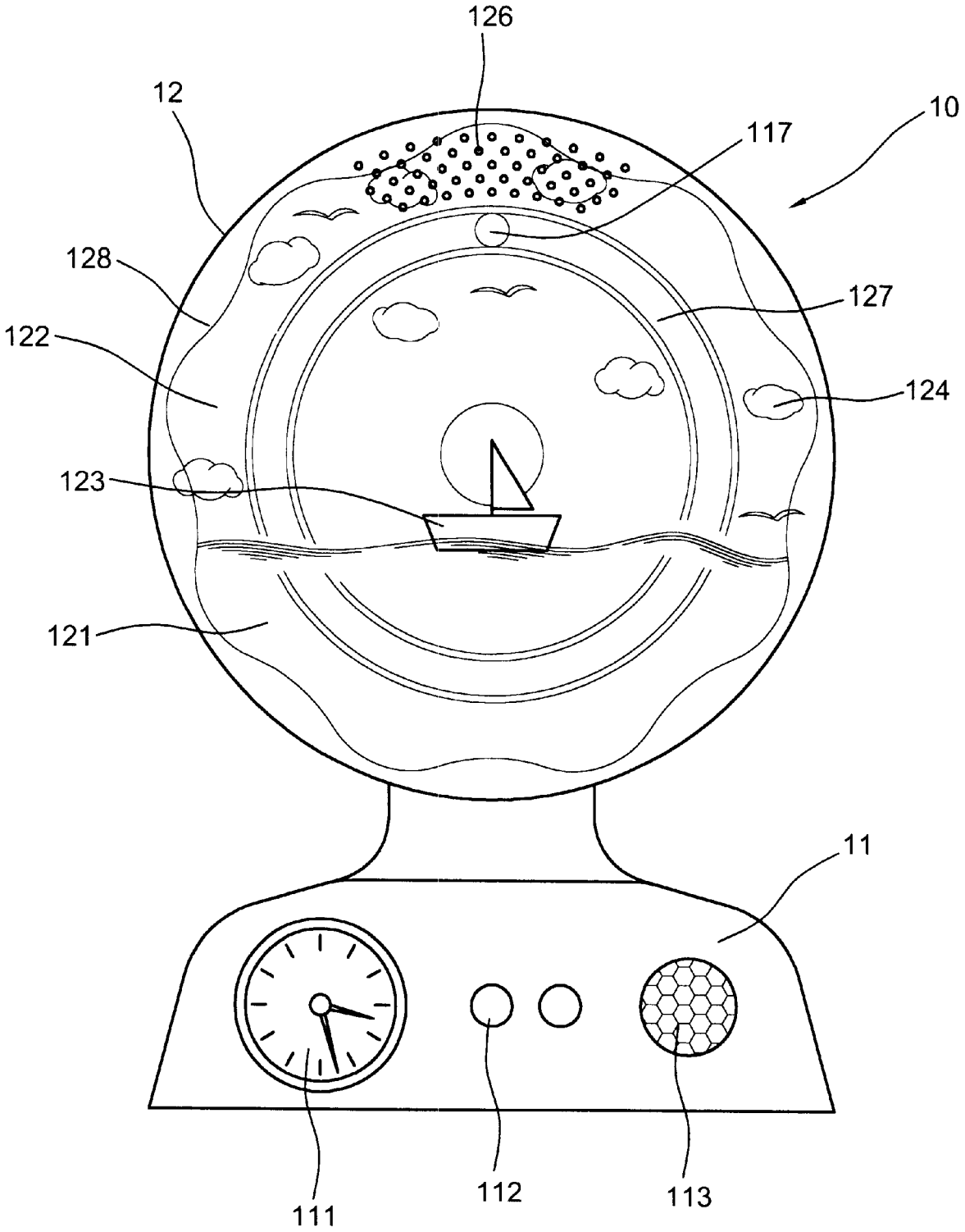
FIG. 2 is an elevation view of FIG. 1.
Figure 3:
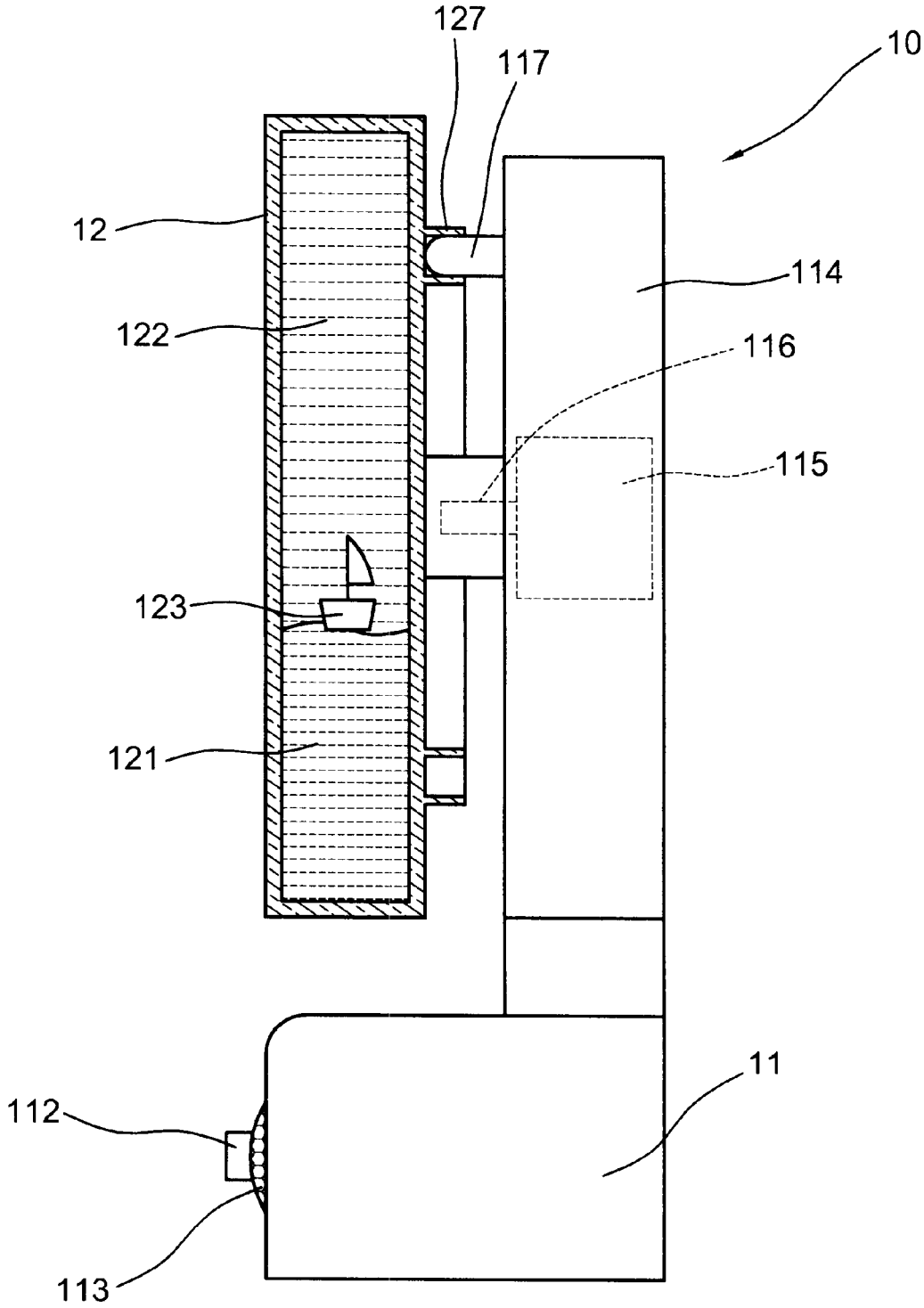
FIG. 3 is a side view and partially sectional view of FIG. 1.

With reference to FIGS. 1, 2 and 3 of the drawings, the structure of an adornment 10 of the present invention comprises generally a base 11 and a rotatable transparent circular container 12. The base can stand on a desk and has clock 111, a microphone 113 and a pair of swivel buttons 112 which connect to a circuit and a battery chamber (not shown) inside the base 11. A disk 114 projected upward from the base 11 including a mini-motor 115 in the center connected respectively to the circuit and the rotatable transparent circular container 12 via an axis 116 and controlled by the buttons 112 one of which turns on the motor 115 and controls its speed, the other of which controls the microphone 113. The container 12 contains two liquids of different specific gravities such as the water 121 and the oil 122, a buoy ornament such as a sail boat 123 disposed at the interface between water 121 and the oil 122, due to the specific gravity, the sail boat always buoys on the water 121, a painting on the inner surface of the container 12 including clouds 124 and birds 125 averagely dispersed spaced apart and visible through the transparent oil 122 but invisible through the blue water 121 a plurality of small transparent windows 126 in the painting, a transparent circular locus 127 concentrically disposed in the back which is enclosed by a pair of concentric protrudent circles and a wave like flange 128 projected inward from the edge of the container 12. When rotating the container 12 the water 121 and oil 122 bump on the wave lick flange 128 will make waves therebetween. Further, a small lamp or LED 117 on the disk 114 has the light to pass through the small transparent windows 126 and the locus 127 to provide a glinting effect.

Based on the above discussed structure, when in the broad daylight, the lamp 117 will be adjusted to be more bright as a sunshine through the locus 127. When in the night, the lamp 117 will be adjusted to be obscure as a moon light and stars on the back of the container 12. The microphone 113 broadcasts the music sounding as billows. The motor 115 will drive the container 12 to rotate at every hour for a certain minutes.

Figure 4:
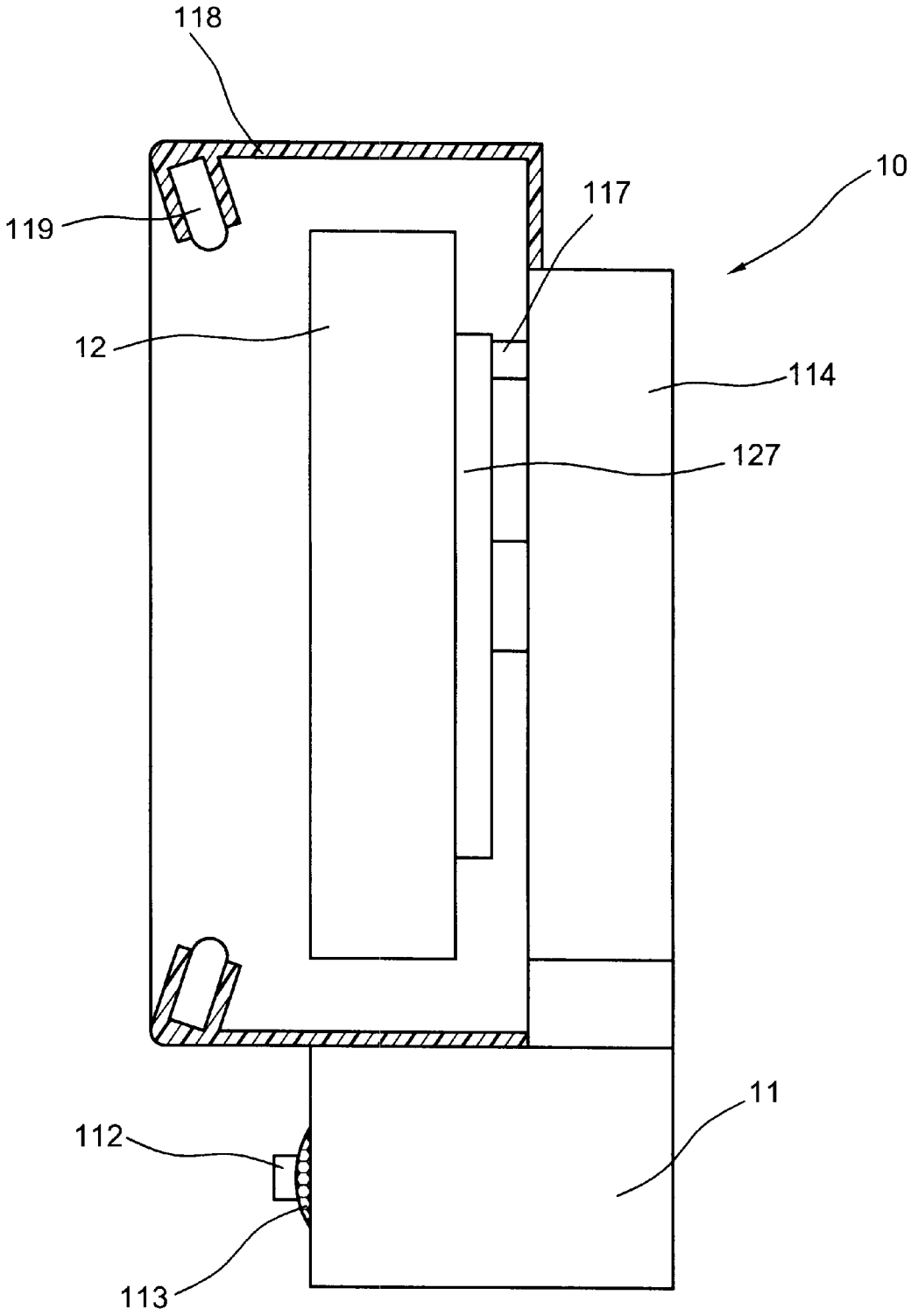
FIG. 4 is a side view of FIG. 1 indicating that a frame may attach to the front of the container.

Referring to FIG. 4, a frame 118 may be attached to the disk 114 and the base 11. The frame 118 has a diameter larger than that of the container 12 and plurality of LED 119 spacedly disposed on the front edges. The LED 119 is provided to light the container 12 and can be glintted together with the small lamp 117.

The specification relating to the above embodiment should be construed as exemplary rather than as limitative of the present invention,with many variations and modifications being readily attainable by a person of average skill in the art without departing from the spirit or scope thereof as defined by the appended claims and their legal equivalents.

I claim:

1. A structure of an adornment comprising:

a base having a clock, a microphone and a pair of swivel buttons on front side, a battery chamber and an electrical circuit in an inside and a disk projected upward from a top of the base, said disk having a mini-motor at center connected to the circuit;

a rotatable transparent circular container positioned in front of the disk and connected to the mini-motor through an axis, said container containing two kinds of liquids of different specific gravities, a buoy, a painting including clouds and birds spacedly dispersed in back, a transparent, concentrical circular locus and a plurality of small windows in the back and a wave like flange projected inward from whole edge thereof;

whereby, said container rotate for few minutes at every hour automatically by the mini-motor.

2. The adornment as recited in claim 1 wherein said pair swivel buttons are respectively controlling the mini-motor and the microphone.

3. The adornment as recited in claim 2 wherein said microphone sounding as a billow.

4. The adornment as recited in claim 1 wherein said liquids are blue water and transparent oil.

5. The adornment as recited in claim 1 wherein said buoy is a model of sail-boat.

6. The adornment as recited in claim 1 wherein said transparent locus is surrounded by a pair of concentrical projections.

7. The adornment as recited in claim 1 further has a small lamp on front of the disk.

8. The adornment as recited in claim 1 further has a frame of a diameter larger than that of the container attached respectively to the disk and the base including a plurality of LEDS on front edges to light the container.

9. The adornment as recited in claim 8 wherein said LEDS are glinting together with the small lamp.

* * * * *